US008353354B2

(12) United States Patent
Hall et al.

(10) Patent No.: US 8,353,354 B2
(45) Date of Patent: Jan. 15, 2013

(54) CRAWLER SYSTEM FOR AN EARTH BORING SYSTEM

(76) Inventors: David R. Hall, Provo, UT (US); Scott S. Dahlgren, Alpine, UT (US); Jonathan Marshall, Provo, UT (US)

( * ) Notice: Subject to any disclaimer, the term of this patent is extended or adjusted under 35 U.S.C. 154(b) by 274 days.

(21) Appl. No.: 12/836,570

(22) Filed: Jul. 14, 2010

(65) Prior Publication Data

US 2012/0012337 A1 Jan. 19, 2012

(51) Int. Cl.
*E21B 23/00* (2006.01)

(52) U.S. Cl. ..... 166/381; 166/206; 166/212; 175/98; 175/230

(58) Field of Classification Search ..... 166/381, 166/212, 206; 175/98, 230
See application file for complete search history.

(56) References Cited

U.S. PATENT DOCUMENTS

| | | | | |
|---|---|---|---|---|
| 1,921,135 | A | 8/1933 | Santiago | |
| 2,170,452 | A | 8/1939 | Grant | |
| 2,427,052 | A | 9/1947 | Grant | |
| 3,126,065 | A | 3/1964 | Chadderdon | |
| 3,703,104 | A | 11/1972 | Tamplen | |
| 3,823,773 | A | 7/1974 | Nutter | |
| 3,986,554 | A | 10/1976 | Nutter | |
| 4,081,042 | A | 3/1978 | Johnson | |
| 4,491,187 | A | 1/1985 | Russell | |
| 4,655,289 | A | 4/1987 | Schoeffler | |
| 4,895,214 | A | 1/1990 | Schoeffler | |
| 5,230,390 | A | 7/1993 | Zastresek | |
| 5,316,094 | A | 5/1994 | Pringle | |
| 5,499,687 | A | 3/1996 | Lee | |
| 5,553,678 | A | 9/1996 | Barr | |
| 5,609,178 | A | 3/1997 | Hennig | |
| 5,673,763 | A | 10/1997 | Thorp | |
| 5,685,379 | A | 11/1997 | Barr | |
| 5,695,015 | A | 12/1997 | Barr | |
| 5,706,905 | A | 1/1998 | Barr | |
| 5,730,222 | A | 3/1998 | Rike | |
| 5,794,703 | A * | 8/1998 | Newman et al. | 166/381 |
| 5,803,185 | A | 9/1998 | Barr | |
| 6,003,606 | A | 12/1999 | Moore et al. | |
| 6,089,323 | A | 7/2000 | Newman et al. | |
| 6,089,332 | A | 7/2000 | Barr | |
| 6,142,250 | A | 11/2000 | Griffin | |
| 6,230,813 | B1 * | 5/2001 | Moore et al. | 166/381 |
| 6,286,592 | B1 * | 9/2001 | Moore et al. | 166/50 |
| 6,679,341 | B2 * | 1/2004 | Bloom et al. | 175/51 |
| 6,717,283 | B2 | 4/2004 | Skinner | |

(Continued)

FOREIGN PATENT DOCUMENTS

GB 2398308 A * 8/2004

*Primary Examiner* — Jennifer H Gay
(74) *Attorney, Agent, or Firm* — Philip W. Townsend, III

(57) ABSTRACT

A crawler system for an earth boring system comprises at least two expandable tools along a common axis and spaced apart from each other along the common axis by a piston cylinder device. The at least two expandable tools comprise a mandrel comprising a tubular body and an outer diameter, a plurality of blades, and a slidable sleeve capable of manipulating the plurality of blades into collapsed and expanded positions. The plurality of blades of one of the at least two expandable tools expand to an expanded position and engage a borehole wall. The piston cylinder device anchors against the engagement between the borehole wall and one of the at least two expandable tools to axially translate the other of the at least two expandable tools.

11 Claims, 8 Drawing Sheets

U.S. PATENT DOCUMENTS

| | | | | |
|---|---|---|---|---|
| 6,732,817 | B2 | 5/2004 | Dewey | |
| 6,854,953 | B2 | 2/2005 | Van Drentham-Susman | |
| 7,036,611 | B2 | 5/2006 | Radford | |
| 7,048,078 | B2 | 5/2006 | Dewey | |
| 7,080,700 | B2 * | 7/2006 | Bloom et al. | 175/51 |
| 7,121,364 | B2 * | 10/2006 | Mock et al. | 175/51 |
| 7,172,026 | B2 * | 2/2007 | Misselbrook | 166/381 |
| 7,188,681 | B2 * | 3/2007 | Bloom et al. | 175/51 |
| 7,275,593 | B2 | 10/2007 | Bloom et al. | |
| 7,308,937 | B2 | 12/2007 | Radford | |
| 7,314,099 | B2 | 1/2008 | Dewey et al. | |
| 7,353,886 | B2 * | 4/2008 | Bloom et al. | 175/51 |
| 7,546,871 | B2 * | 6/2009 | Moyes | 166/134 |
| 7,607,495 | B2 * | 10/2009 | Bloom et al. | 175/51 |
| 7,743,849 | B2 * | 6/2010 | Kotsonis et al. | 175/51 |
| 2002/0029908 | A1 * | 3/2002 | Bloom et al. | 175/99 |
| 2002/0112859 | A1 * | 8/2002 | Bloom et al. | 166/381 |
| 2004/0144548 | A1 * | 7/2004 | Bloom et al. | 166/381 |
| 2004/0182580 | A1 * | 9/2004 | Moore et al. | 166/374 |
| 2005/0145417 | A1 | 7/2005 | Radford | |
| 2005/0217861 | A1 * | 10/2005 | Misselbrook | 166/373 |
| 2005/0247488 | A1 * | 11/2005 | Mock et al. | 175/99 |
| 2006/0108151 | A1 * | 5/2006 | Moore et al. | 175/99 |
| 2007/0000693 | A1 * | 1/2007 | Bloom et al. | 175/51 |
| 2007/0000697 | A1 * | 1/2007 | Moore et al. | 175/99 |
| 2007/0017670 | A1 * | 1/2007 | Bloom et al. | 166/212 |
| 2007/0209806 | A1 * | 9/2007 | Mock | 166/382 |
| 2008/0078559 | A1 * | 4/2008 | Bloom et al. | 166/382 |
| 2008/0105464 | A1 | 5/2008 | Radford | |
| 2008/0128175 | A1 | 6/2008 | Radford et al. | |
| 2008/0142229 | A1 * | 6/2008 | Brisco et al. | 166/380 |
| 2008/0314639 | A1 * | 12/2008 | Kotsonis et al. | 175/51 |
| 2009/0218105 | A1 * | 9/2009 | Hill et al. | 166/383 |
| 2011/0073300 | A1 * | 3/2011 | Mock | 166/212 |
| 2012/0012337 | A1 * | 1/2012 | Hall et al. | 166/381 |

* cited by examiner

CRAWLER SYSTEM FOR AN EARTH BORING SYSTEM

BACKGROUND OF THE INVENTION

The present invention relates to the fields of downhole oil, gas and/or geothermal exploration and more particularly to the fields of tractor systems used to move downhole tools along a borehole with precision movements. Tractor systems of this type are particularly useful in more horizontal borehole sections where weight-on-bit is not as available to move downhole tools. Tractor systems can also be useful when exact advancements are required to obtain accurate readings from downhole sensors.

There currently exists a variety of tractor systems used to move downhole tools. Most downhole tractor systems can be classified in one of two groups: powered-wheel systems and crawler systems. Powered-wheel systems use a plurality of wheels which engage a borehole wall to drive a drill string. Crawler systems use a plurality of arms which extend from the drill string to engage a borehole wall. The arms rhythmically engage and disengage to drive the drill string. The following prior art references disclose various types of crawler systems.

One such crawler system is disclosed in U.S. Pat. No. 6,089,323 to Newman et al., which is herein incorporated by reference for all that it contains. Newman et al. discloses a wellbore tractor system which has at least one slip unit with retractable slips for engaging an interior wall of casing or of a wellbore and at least one movement unit for moving an item. In one aspect while the slip unit is involved in engaging and disengaging from a wellbore, the movement unit moves the item.

Another such crawler system is disclosed in U.S. Pat. No. 6,003,606 to Moore et al., which is herein incorporated by reference for all that it contains. Moore et al. discloses a method of propelling a tool having a generally cylindrical body within a passage using first and second engagement bladders. The first engagement bladder is inflated to assume a position that engages an inner surface of the passage and limits relative movement of the first engagement bladder relative to the inner surface of the passage. An element of the tool then moves with respect to the first engagement bladder. The second engagement bladder is in a position allowing free relative movement between the second engagement bladder and the inner surface of the passage. The first engagement bladder then deflates, allowing free relative movement between the first engagement bladder and the inner surface of the passage. The second engagement bladder is then inflated to assume a position that engages an inner surface of the passage and limits relative movement of the second engagement bladder relative to the inner surface. At this time an element of the tool is moved with respect to the second engagement bladder. This process can be cyclically repeated to allow the tool to generally continuously move forward within the passage.

BRIEF SUMMARY OF THE INVENTION

In one aspect of the present invention, a crawler system for an earth boring system comprises at least two expandable tools along a common axis and spaced apart from each other along the common axis by a piston cylinder device. The at least two expandable tools comprise a mandrel comprising a tubular body and an outer diameter, a plurality of blades, and a slidable sleeve capable of manipulating the plurality of blades into collapsed and expanded positions. The plurality of blades of one of the at least two expandable tools expands to an expanded position and engage a borehole wall. The piston cylinder device anchors against the engagement between the borehole wall and one of the at least two expandable tools to axially translate the other of the at least two expandable tools.

Each blade of the plurality of blades may comprise a peripheral surface which may engage the borehole wall when in an expanded position. Each peripheral surface may comprise at least one traction component which may comprise a ramp. The combined peripheral surfaces of the plurality of blades may engage a complete circumference of the borehole wall.

A drill bit and a second piston cylinder device may be disposed between the drill bit and at least one of the expandable tools.

A plurality of channels may be disposed on at least one fin of a plurality of fins which extend from the outer diameter of the mandrel of at least one of the expandable tools. A plurality of channels may also be disposed on the slidable sleeve and at least one blade of the plurality of blades. The slidable sleeve may manipulate the plurality of blades by engaging the plurality of channels on an interior surface of the at least one blade with the plurality of channels on the at least one fin and engaging the plurality of channels on an exterior surface of the at least one blade with the plurality of channels on the slidable sleeve.

A drilling fluid passage may be disposed between the slidable sleeve and the at least one blade of at least one of the expandable tools. The drilling fluid passage may allow drilling fluid to flow therethrough.

The piston cylinder device may comprise a cylinder connected to the mandrel of at least one of the expandable tools and a piston connected to the mandrel of another of the expandable tools. The piston cylinder device may comprise pressure chambers disposed on one or two sides of a piston which may axially translate at least one of the expandable tools. When a pressure chamber is disposed on only one side of a piston, weight-on-bit may translate another of the expandable tools.

In another aspect of the present invention, a crawler system for an earth boring system comprises an expandable tool along a common axis and spaced apart from each other along the common axis. Each of the at least two expandable tools may comprises a mandrel comprising a tubular body and an outer diameter, a plurality of blades, and a slidable sleeve which may be capable of manipulating the plurality of blades into collapsed and expanded positions. A drill pipe comprising a tubular body may be disposed coaxial with and passing through each mandrel of the at least two expandable tools. The plurality of blades of one of the at least two expandable tools may expand into an expanded position and engage a borehole wall. The drill pipe may anchor against the engagement between the borehole wall and one of the at least two expandable tools to axially translate another expandable tool of the at least two expandable tools.

The mandrels of the at least two expandable tools may comprise a clasping mechanism which may grip to the drill pipe.

The drill pipe may comprise a thread form which interacts with a thread form which may be disposed on each expandable tool. As the drill pipe anchors against the engagement between the borehole wall and one of the at least two expandable tools the thread form of the drill pipe may rotate past the thread form of the expandable tool to axially translate the other expandable tool.

A driving mechanism may push the mandrels of each of the at least two expandable tools causing the mandrels to axially translate.

In another aspect of the present invention, a method of translating at least two expandable tools may comprise providing first and second expandable tools which may be disposed along a common axis and spaced apart from each other along the common axis and each may comprise a mandrel comprising a tubular body and an outer diameter, a plurality of blades, and a slidable sleeve which may be capable of manipulating the plurality of blades into collapsed and expanded position, engaging a borehole wall by expanding the plurality of blades of the first expandable tool, translating the mandrel of the second expandable axially, engaging the borehole wall by expanding the plurality of blades of the second expandable tool, and translating the mandrel of the first expandable tool axially.

The plurality of blades of at least one of the expandable tools may collapse from engagement with the borehole wall as the mandrel of the expandable tool translates axially in one direction.

A drill bit may also be provided and wherein the drill bit may translate axially.

DETAILED DESCRIPTION OF THE INVENTION AND THE PREFERRED EMBODIMENT

Figure 1:
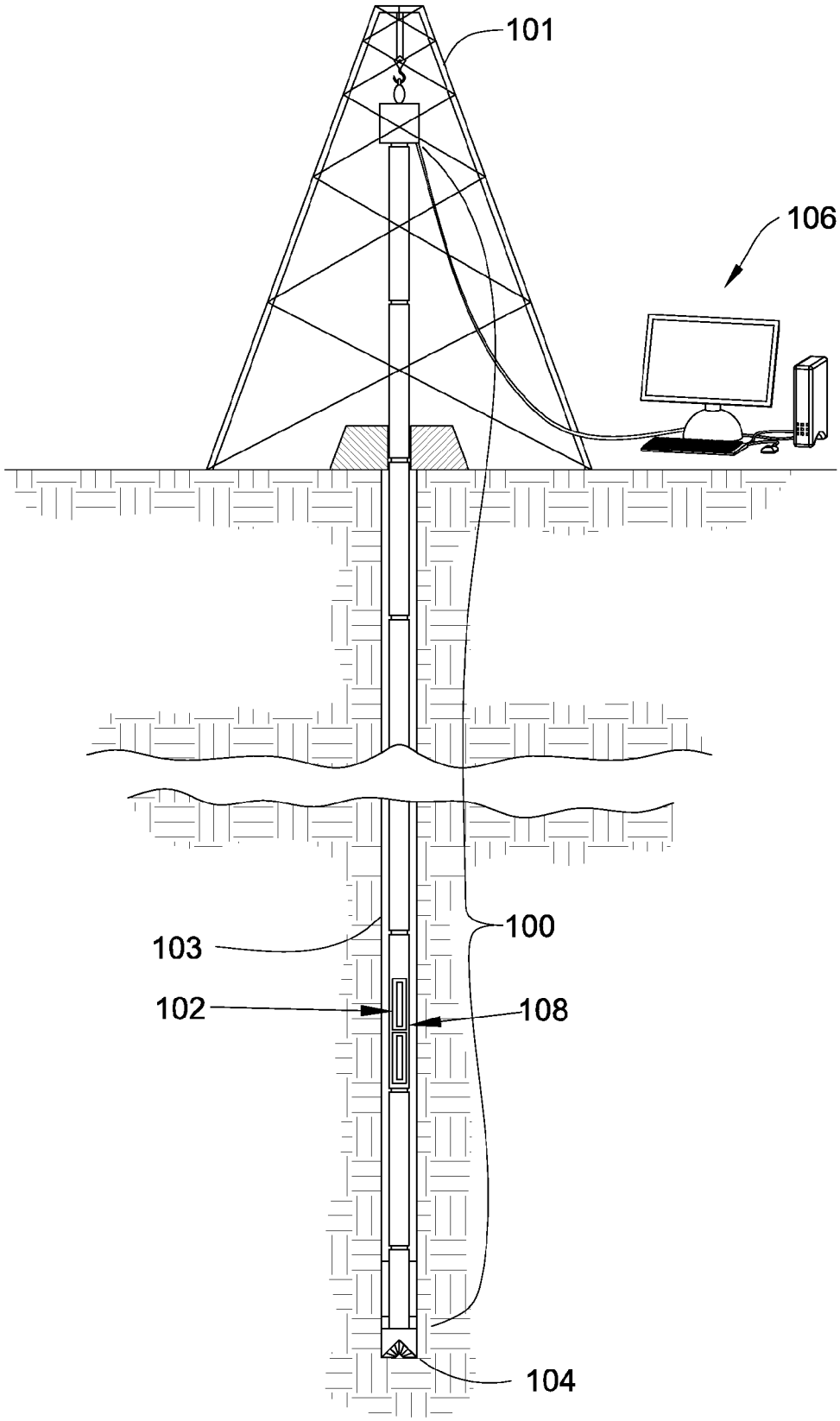
FIG. 1 is a cutaway view of an embodiment of a drilling operation.

Referring now to the figures, FIG. 1 discloses an embodiment of a drilling operation comprising a drilling derrick 101 supporting a drill string 100 inside a borehole 103. While the embodiment shown includes a drill string 100, the drilling operation may alternately comprise a cable, a wireline, or a coiled tubing inside the borehole 103. The drill string 100 may comprise a drill bit 104. The drill string 100 may also comprise one or more downhole components 102. In this embodiment, the one or more downhole components 102 may comprise a crawler system 108 used for driving the drill string 100. The downhole drill string 100 may comprise electronic equipment able to send signals through a data communication system to a computer or data logging system 106 located at the surface.

Figures 2A, 2B:
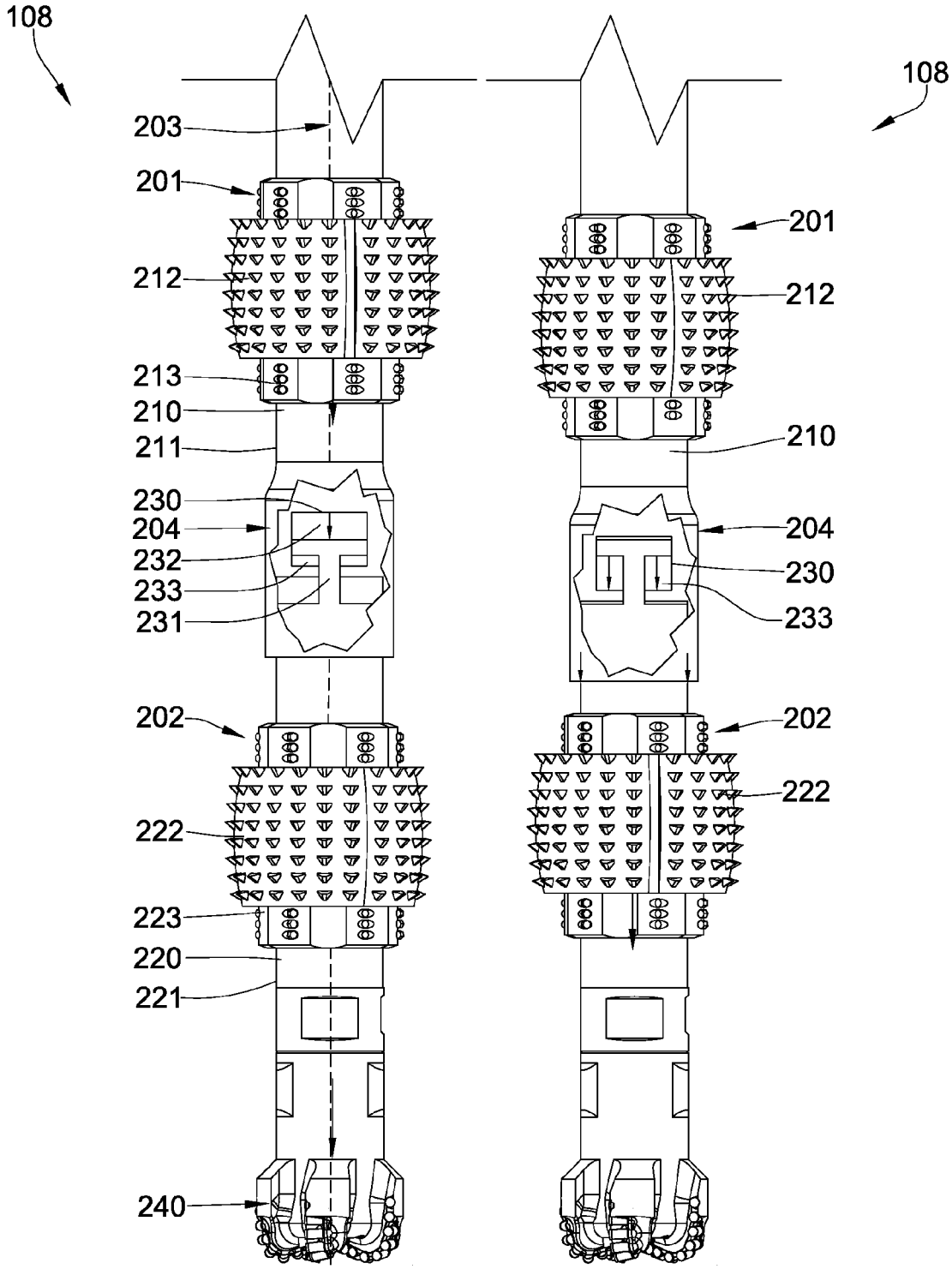
FIG. 2*a* is a perspective view of an embodiment of a crawler system.
FIG. 2*b* is a perspective view of another embodiment of a crawler system.

FIG. 2*a* and FIG. 2*b* each disclose an embodiment of a crawler system 108 which may comprise a first expandable tool 201 and a second expandable tool 202 which may be disposed along a common axis 203 and spaced apart from each other along the common axis 203 by a piston cylinder device 204. The first expandable tool 201 may comprise a mandrel 210 comprising a tubular body and an outer diameter 211, a plurality of blades 212 and a slidable sleeve 213. The slidable sleeve 213 may be capable of manipulating the plurality of blades 212 into collapsed and expanded positions. In these embodiments, the slidable sleeve 213 may manipulate the plurality of blades 212 by sliding up the mandrel 210. The second expandable tool 202 may also comprise a mandrel 220 comprising a tubular body and an outer diameter 221, a plurality of blades 222 and a slidable sleeve 223. The slidable sleeve 223 may also be capable of manipulating the plurality of blades 222 into collapsed and expanded positions. In these embodiments, the slidable sleeve 223 may manipulate the plurality of blades 222 by sliding up the mandrel 220.

The piston cylinder device 204 may comprise a cylinder 230 connected to the mandrel 210 of the first expandable tool 201 and a piston 231 connected to the mandrel 220 of the second expandable tool 202. A first pressure chamber 232 and a second pressure chamber 233 may be disposed in the piston cylinder device 204.

FIG. 2*a* discloses a first part of a method of translating the first expandable tool 201 and second expandable tool 202. The plurality of blades 212 of the first expandable tool 201 may expand to an expanded position such that it could engage a borehole wall and form an anchor to immobilize the first expandable tool 201. The piston cylinder device 204 may anchor against the engagement between the borehole wall and the first expandable tool 201 to axially translate the second expandable tool 202. The first pressure chamber 232 may fill with fluid causing pressure to be built up and pushing against the piston 231 causing the piston 231 and thus the second expandable tool 202 to translate axially down the borehole. The fluid may then drain from the first pressure chamber 232. The fluid may be drilling fluid passing through the crawler system 108 or hydraulic fluid in a closed system.

FIG. 2*b* discloses a second part of a method of translating the first expandable tool 201 and second expandable tool 202. The plurality of blades 222 of the second expandable tool 202 may expand to an expanded position and engage a borehole wall. The plurality of blades 222 engaging the borehole wall may create an anchor to immobilize the second expandable tool 202. The piston cylinder device 204 may anchor against the engagement between the borehole wall and the expandable tool 202 to axially translate the expandable tool 201. The second pressure chamber 233 may fill with fluid causing pressure to be built up and pushing against the cylinder 230 causing the cylinder 230 and thus the expandable tool 201 to translate axially down the borehole. The plurality of blades 212 may release from the borehole wall and collapse into a collapsed position removing the anchor between the borehole and plurality of blades 212 when the mandrel 210 of the expandable tool 201 axially translates downward. The fluid may then drain from the second pressure chamber 233.

The crawler system 108 may also comprise a drill bit 240. The drill bit 240 and the second expandable tool 202 are connected so that as the second expandable tool 202 axially translates down the borehole, the drill bit 240 also moves down the borehole and may be able to engage an earthen formation. The drill bit 240 may translate a couple of inches at a time with the crawler system 108.

These embodiments disclose the crawler system 108 translating down the borehole, however, the method may be applied to translate the crawler system 108 up the borehole as well. It is believed that translating up and down the borehole may be significant when containing a sensor so to position the sensor in an accurate location.

Figure 3A:
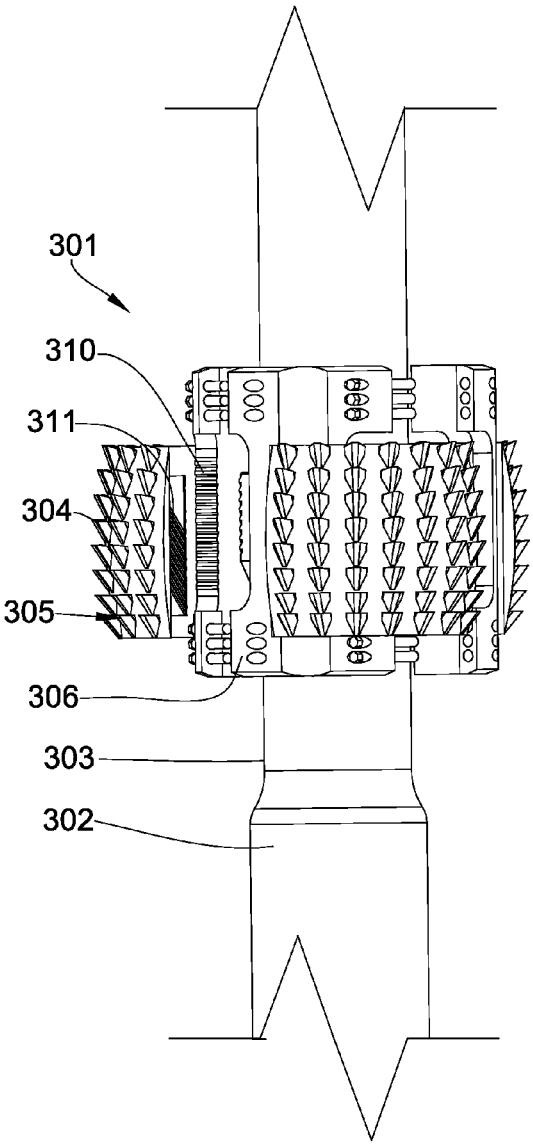
FIG. 3*a* is an exploded view of an embodiment of an expandable tool.
Figure 3B:
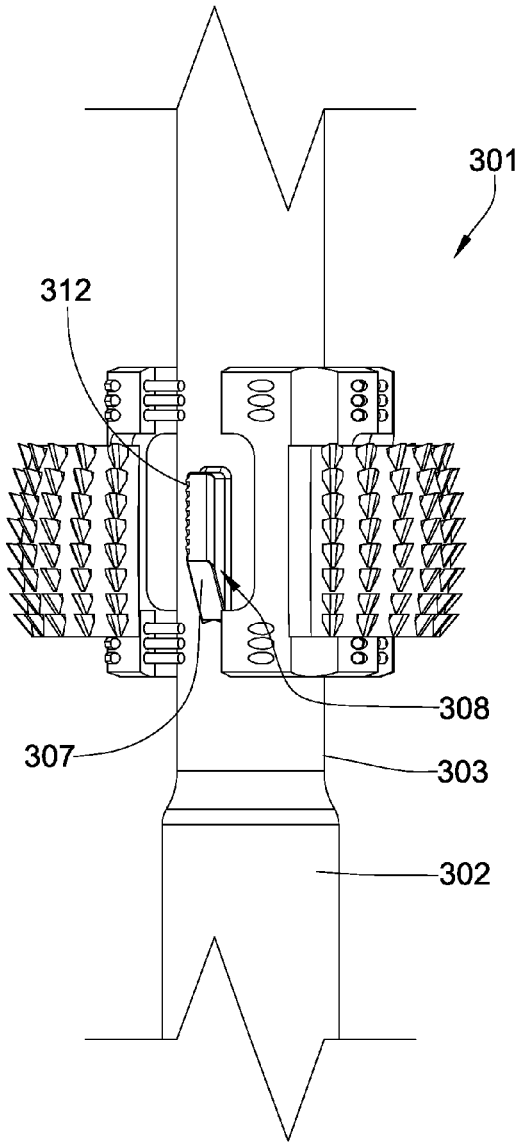
FIG. 3*b* is an exploded view of another embodiment of an expandable tool.

FIG. 3*a* and FIG. 3*b* each disclose an exploded view of an embodiment of an expandable tool 301 of the at least two expandable tools in a crawler system. The expandable tool 301 may comprise a mandrel 302 comprising a tubular body and an outer diameter 303, at least one blade 304 of the plurality of blades 305 and a slidable sleeve 306. It is believed that the mandrel 302 may increase the stiffness of the expandable tool 301 therefore increasing the efficiency and decreasing the chances for something to break.

FIG. 3*a* discloses a plurality of channels 310 disposed on the slidable sleeve 306 and a plurality of channels 311 disposed an interior surface of the at least one blade 304.

FIG. 3*b* discloses a plurality of channels 312 disposed on at least one fin 307 of a plurality of fins 308. The plurality of fins 308 may extend from the outer diameter 303 of the mandrel 302.

The plurality of channels 310 disposed on the slidable sleeve 306 may mate with a plurality of channels disposed on an exterior surface of the at least one blade 304. The plurality of channels 312 disposed on the at least one fin 307 may mate with the plurality of channels 311 disposed on the interior surface of the at least one blade 304. The slidable sleeve 306 may manipulate the plurality of blades 305 by engaging the plurality of channels 310 on the slidable sleeve 306 with the plurality of channels disposed on the exterior surface of the at least one blade 304 and engaging the plurality of channels 312 disposed on the at least one fin 307 with the plurality of channels 311 disposed on the interior surface of the at least one blade 304.

Figure 4A:
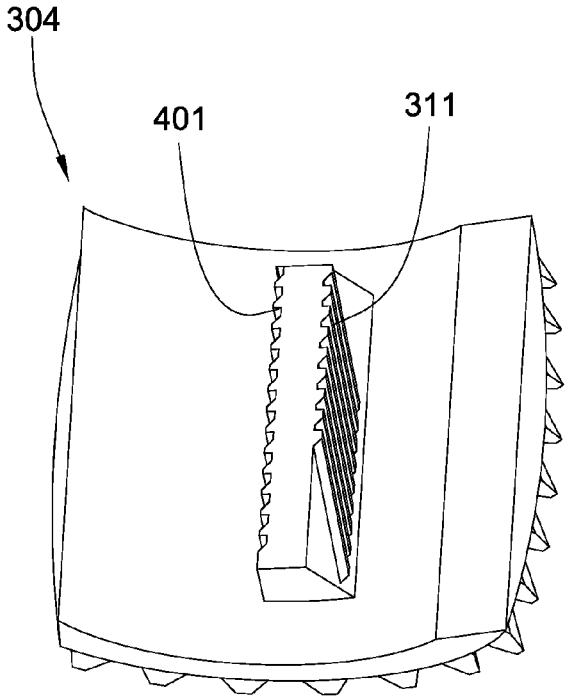
FIG. 4*a* is a perspective view of an embodiment of a blade of the plurality of blades.
Figure 4B:
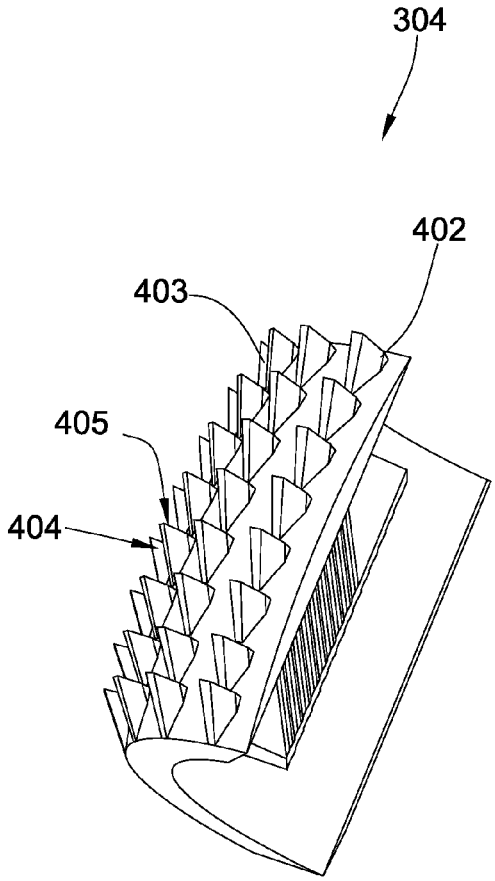
FIG. 4*b* is a perspective view of another embodiment of a blade of the plurality of blades.

FIG. 4*a* and FIG. 4*b* each disclose an embodiment of the at least one blade 304 of the plurality of blades. The embodiment of FIG. 4*a* discloses the plurality of channels 311 disposed on the interior surface of the at least one blade 304. This embodiment may also disclose the plurality of channels 401 disposed on the exterior surface of the at least one blade 304. The embodiment of FIG. 4*b* discloses a peripheral surface 402 of the at least one blade 304. The peripheral surface 402 may engage the borehole wall when the at least one blade 304 is in an expanded position. The peripheral surface may comprise at least one traction component 403 which may comprise a ramp 404 and a surface 405 perpendicular to the at least one blade 304. When the at least one blade 304 is in an expanded position, the traction component 403 may grip to the borehole wall forming an anchor which immobilizes the expandable tool. The surface 405 may be perpendicular to the at least one blade 304 to better grip into the borehole wall. As the at least one blade 304 begins to expand, the traction component 403 may come into contact with the borehole wall and the forces acting downward on the traction component 403 may push the surface 405 into the borehole wall. The ramp 404 allows the at least one blade 304 to collapse without the help of another mechanism. As the mandrel connected with the at least one blade 304 translates downward, the at least one blade 304 may begin to collapse. The at least one blade 304 may collapse due to the forces acting upwards on the ramp 404 of the traction component 403. The slope of the ramp 404 combined with the plurality of channels 311 and the plurality of channels 401, allows the at least one blade 304 to collapse from the engagement with the borehole wall.

Figure 5:
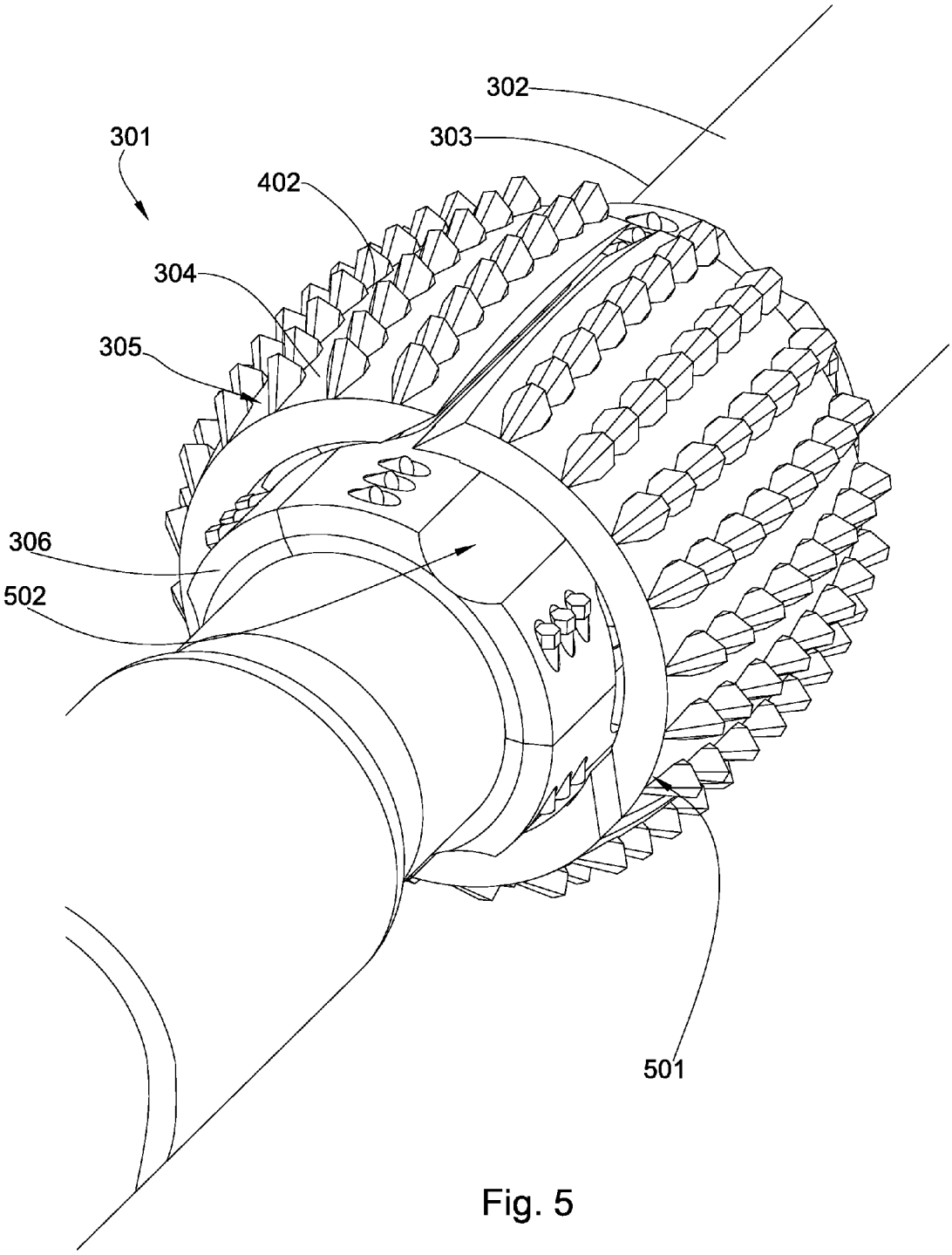
FIG. 5 is a perspective view of an embodiment of an expandable tool.

FIG. 5 discloses an embodiment of an expandable tool 301 of the at least two expandable tools in a crawler system. The expandable tool 301 may comprise a mandrel 302 comprising a tubular body and an outer diameter 303, at least one blade 304 of a plurality of blades 305, and a slidable sleeve 306. Each blade of the plurality of blades 305 may comprise a peripheral surface 402 which may engage the borehole wall when the blade is in an expanded position. The combined peripheral surfaces 501 of the plurality of blades 305 may engage a complete circumference of the borehole wall. It is believed that engaging the complete circumference of the borehole wall will minimize the amount of stress put on the borehole wall reducing the chances for the borehole to cave in. Engaging the complete circumference of the borehole wall may also allow the expandable tool to maximize the grip of the plurality of blades 305 on the borehole wall reducing the chances for the plurality of blades 305 to break the engagement.

This embodiment also discloses a drilling fluid passage 502 disposed between the slidable sleeve 306 and the at least one blade 304. The drilling fluid passage 502 allows drilling fluid to flow between the plurality of blades 305 and the slidable sleeve 306 even when the plurality of blades 305 is in an expanded position.

Figure 6A:
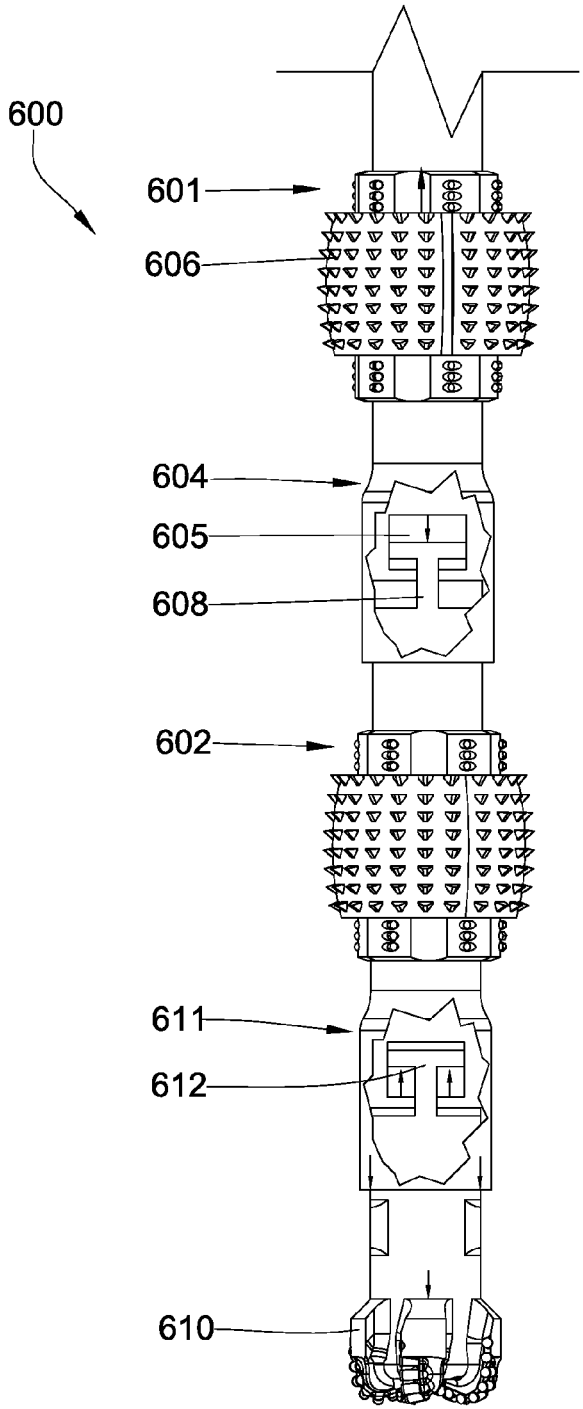
FIG. 6*a* is a perspective view of an embodiment of a crawler system.
Figure 6B:
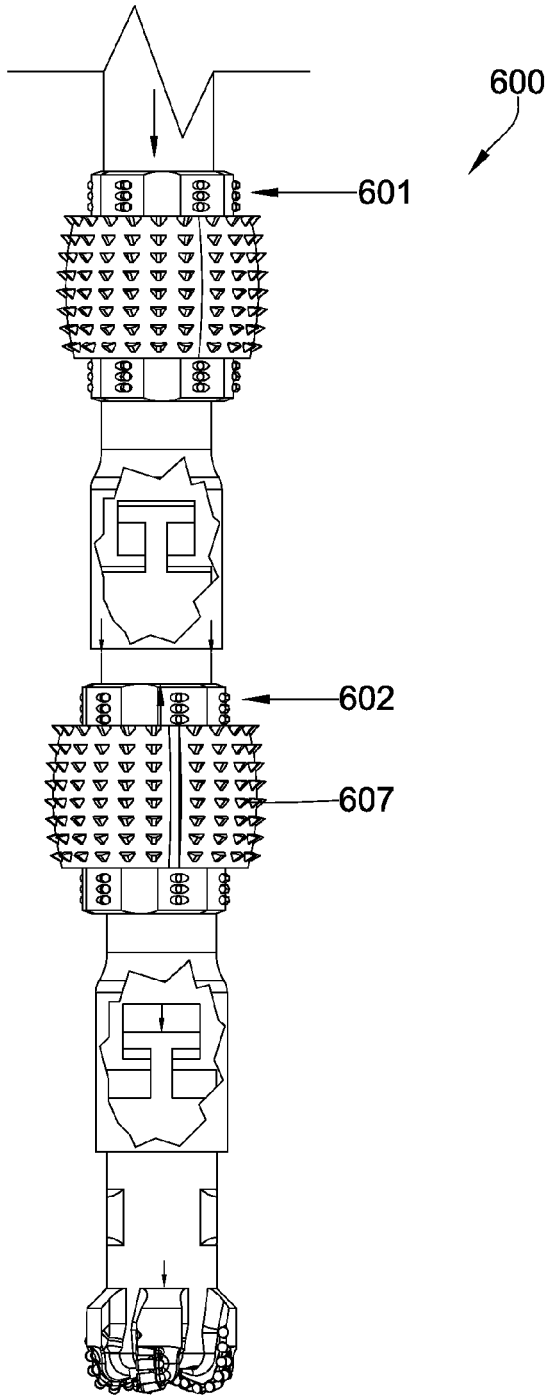
FIG. 6*b* is a perspective view of another embodiment of a crawler system.

FIG. 6*a* and FIG. 6*b* each disclose an embodiment of a crawler system 600 which may comprise a first expandable tool 601 and a second expandable tool 602. The first expandable tool 601 and the second expandable tool 602 may be spaced apart by a piston cylinder device 604. The piston cylinder device 604 may comprise a single pressure chamber 605 disposed on one side of a piston 608. The embodiment in FIG. 6*a* discloses a plurality of blades 606 of the first expandable tool 601 in an expanded position such that it could engage a borehole wall and form an anchor to immobilize the first expandable tool 601. A fluid may then fill the single pressure chamber 605 causing pressure to be built up and push against the piston 608. The fluid may be drilling fluid passing through the crawler system 600 or hydraulic fluid in a closed system. The piston 608 may be connected with the second expandable tool 602 such that the pressure pushing against the piston 608 causes the piston 608 and thus the second expandable tool 602 to translate axially down the borehole. The embodiment in FIG. 6*b* discloses that after the second expandable tool 602 has translated a plurality of blades 607 of the second expandable tool 602 may expand to an expanded position such that it could engage a borehole wall and form an anchor to immobilize the second expandable tool 602. The first expandable tool 601 may then translate due to weight-on-bit pushing on the first expandable tool 601.

The embodiments shown also disclose a drill bit 610 and a second piston cylinder device 611 disposed between the drill bit 610 and the second expandable tool 602. It is believed that if the drill bit 610 can be constantly engaged with an earthen formation then it will be more effective in a drilling process. When the plurality of blades 606 of the first expandable tool 601 expand and engage the borehole wall, the piston cylinder device 604 may push and translate the expandable tool 602 downward. At this point the drill bit 610 and the second expandable tool 602 are connected so that as the expandable tool 602 translates downward, the drill bit 610 may move downward also. After the second expandable tool 602 has translated downward, the plurality of blades 607 of the second expandable tool 602 expand and engage the borehole wall. As the first expandable tool 601 translates downward by the applied weight-on-bit, the second piston cylinder device 611 may fill with fluid causing pressure to be built up and push a piston 612. The fluid may be drilling fluid passing through the crawler system 600 or hydraulic fluid in a closed system. The piston 612 may be connected with the drill bit 610 such that the pressure pushing the piston 612 causes the piston 612 and thus the drill bit 610 to move downward. After the first expandable tool 601 has translated downward, the plurality of blades 606 of the first expandable tool 601 may expand and engage the borehole wall. As the second expandable tool 602 translates downward, it may again be connected with the drill bit 610. As the drill bit 610 is translating downward due to the connection with the second expandable tool 602, the piston 612 of the second piston cylinder device 611 may reset to be able to push the drill bit 610 downward after the second expandable tool 602 stops translating.

Figure 7A:
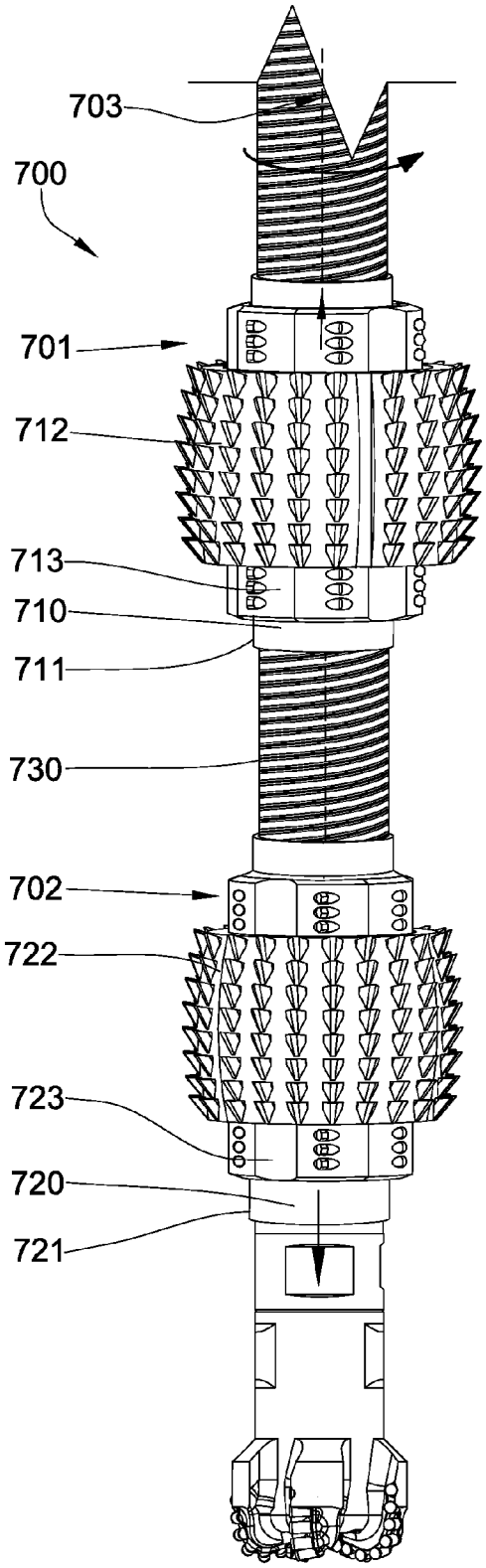
FIG. 7*a* is a perspective view of an embodiment of a crawler system.
Figure 7B:
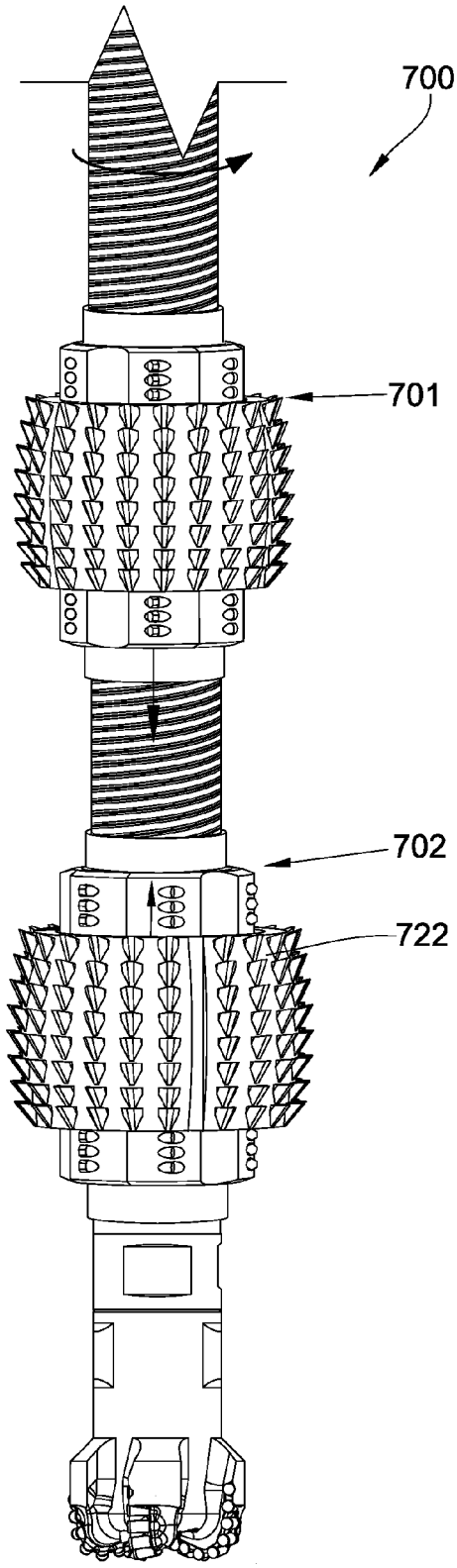
FIG. 7*b* is a perspective view of another embodiment of a crawler system.

FIG. 7*a* and FIG. 7*b* each disclose an embodiment of a crawler system 700 which may comprise a first expandable tool 701 and a second expandable tool 702 which may be disposed along a common axis 703 and spaced apart from each other along the common axis 703. The first expandable tool 701 may comprise a mandrel 710 comprising a tubular body and an outer diameter 711, a plurality of blades 712, and a slidable sleeve 713. The slidable sleeve 713 may be capable of manipulating the plurality of blades 712 into collapsed and expanded positions. In this embodiment, the slidable sleeve 713 may manipulate the plurality of blades 712 by sliding up the mandrel 710. The second expandable tool 702 may also comprise a mandrel 720 comprising a tubular body and an outer diameter 721, a plurality of blades 722, and a slidable sleeve 723. The slidable sleeve 723 may be capable to manipulating the plurality of blades 722 into collapsed and expanded positions. In this embodiment, the slidable sleeve 723 may manipulate the plurality of blades 723 by sliding up the mandrel 720.

These embodiments may also comprise a drill pipe 730 comprising a tubular body and disposed coaxial with and passing through the mandrel 710 of the first expandable tool 701 and the mandrel 720 of the second expandable tool 702. The drill pipe may comprise a thread form which interacts with a thread form disposed on the mandrel 710 of the first expandable tool 701 and the mandrel 720 of the second expandable tool 702.

FIG. 7*a* discloses a first part of a method of translating the first expandable tool 701 and second expandable tool 702. The plurality of blades 712 of the expandable tool 701 may expand to an expanded position capable of engaging a borehole wall and creating an anchor to immobilize the expandable tool 701. The thread form of the drill pipe 730 may rotate past the thread form on the mandrel 710 of the first expandable tool 701 to axially translate the second expandable tool 702 downward.

FIG. 7*b* discloses a second part of a method of translating the first expandable tool 701 and second expandable tool 702. The plurality of blades 722 of the expandable tool 702 may expand to an expanded position capable of engaging a borehole wall and creating an anchor to immobilize the expandable tool 702. The thread form of the drill pipe 730 may rotate to axially translate the first expandable tool 701 downward.

Figure 8A:
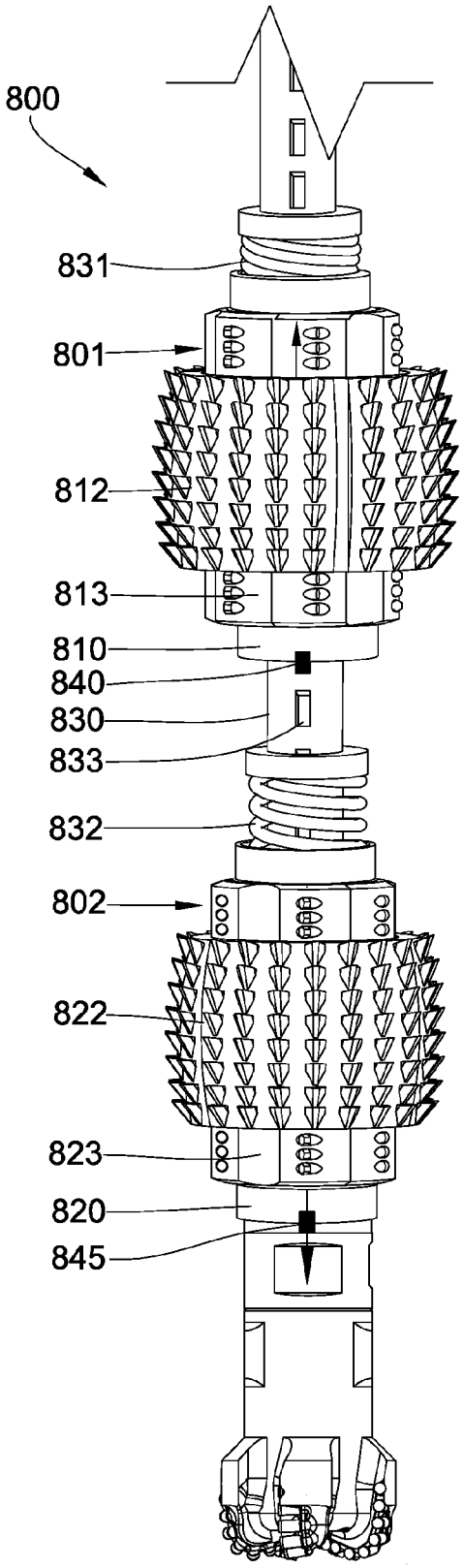
FIG. 8*a* is a perspective view of an embodiment of a crawler system.
Figure 8B:
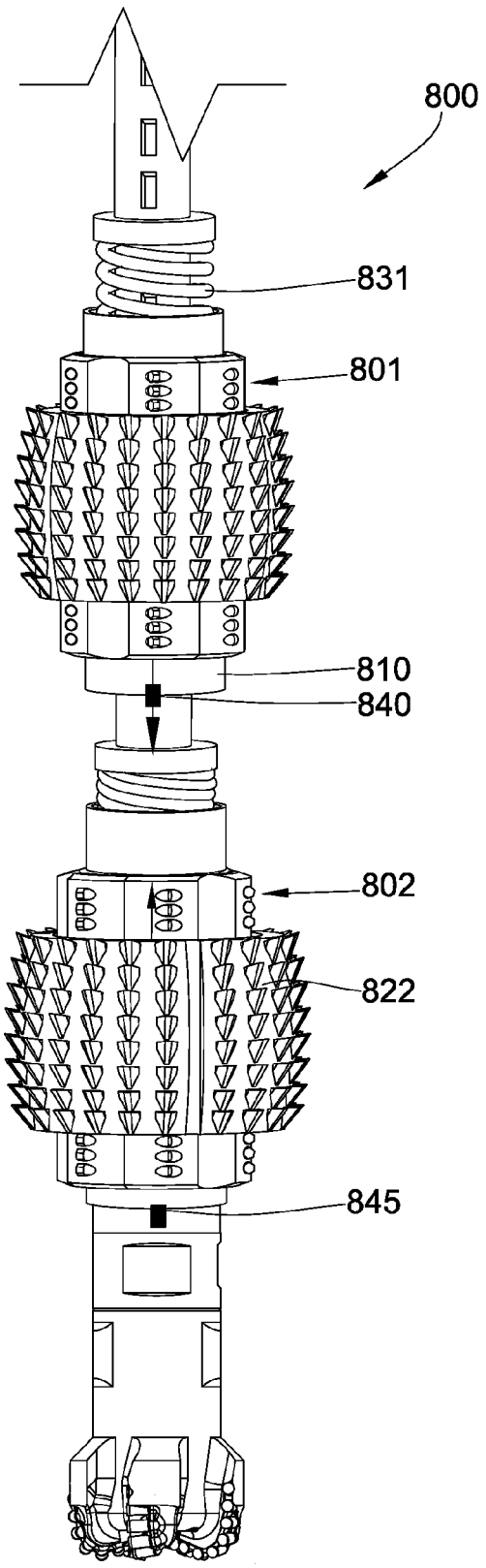
FIG. 8*b* is a perspective view of another embodiment of a crawler system.

FIG. 8*a* and FIG. 8*b* each disclose an embodiment of a crawler system 800 which may comprise a first expandable tool 801, a second expandable tool 802 and a drill pipe 830. The first expandable tool 801 may comprise a mandrel 810, a plurality of blades 812, and a slidable sleeve 813 which may be capable of manipulating the plurality of blades 812 into collapsed and expanded positions. In this embodiment, the slidable sleeve 813 may manipulate the plurality of blades 812 by sliding along the mandrel 810. The second expandable tool 802 may also comprise a mandrel 820, a plurality of blades 822, and a slidable sleeve 823 which may be capable of manipulating the plurality of blades 822 into collapsed and expanded positions. In this embodiment, the slidable sleeve 823 may manipulate the plurality of blades 822 by sliding along the mandrel 820.

In these embodiments the mandrel 810 of the first expandable tool 801 and mandrel 820 of the second expandable tool 802 each comprise first and second clasping mechanisms 840, 845 respectfully to grip the drill pipe 830 and disallow the first expandable tool 801 and second expandable tool 802 to translate freely. The clasping mechanisms 840, 845 may comprise cogs (not shown) which may interact with inserts 833 or may clasp directly to the drill pipe 830. In these embodiments, a first driving mechanism 831, shown as a spring, is disposed on the drill pipe 830 and above the first expandable tool 801 and a second driving mechanism 832, shown as a spring, is disposed on the drill pipe 830 and above the second expandable tool 802. The first driving mechanism 831 and second driving mechanism 832 may allow the first expandable tool 801 and the second expandable tool 802 to translate axially.

FIG. 8*a* discloses a first part of a method of translating the first expandable tool 801 and second expandable tool 802. The plurality of blades 812 of the expandable tool 801 may expand to an expanded position capable of engaging a borehole wall and creating an anchor to immobilize the expandable tool 801. The spring 832 may push the mandrel 820 of the second expandable tool 802 allowing the expandable tool 802 to axially translate.

FIG. 8*b* discloses a second part of a method of translating the first expandable tool 801 and second expandable tool 802. The plurality of blades 822 of the second expandable tool 802 may expand to an expanded position capable of engaging a borehole wall and creating an anchor to immobilize the expandable tool 802. The spring 831 may push the mandrel 810 of the first expandable tool 801 allowing the expandable tool 801 to axially translate.

In the description, various embodiments, operating parameters and components of the embodiments are described with directional language, such as "above," "below," "up," "down," and words of similar import designating directions shown in the drawings. Such directional terminology is used for relative description and clarity and is not intended to limit the orientation of any embodiment or component of any embodiment to a particular direction or orientation.

Whereas the present invention has been described in particular relation to the drawings attached hereto, it should be understood that other and further modifications apart from those shown or suggested herein, may be made within the scope and spirit of the present invention.

What is claimed is:

1. A crawler system for an earth boring system, comprising:

at least two expandable tools disposed along a common axis spaced apart from each other along the common axis;

wherein each of the at least two expandable tools comprises a mandrel comprising a tubular body and an outer diameter, a plurality of blades, and a slidable sleeve capable of manipulating the plurality of blades into collapsed and expanded positions;

wherein when the plurality of blades of one of the at least two expandable tools is in an expanded position the plurality of blades engage a borehole wall;

further comprising a piston cylinder device disposed between the at least two expandable tools which anchors against the engagement between the borehole wall and one of the at least two expandable tools to axially translate the other of the at least two expandable tools; and wherein the piston cylinder device comprises a cylinder connected to the mandrel of at least one of the expandable tools and a piston connected to the mandrel of another of the expandable tools.

2. The tractor system of claim 1, wherein each blade of the plurality of blades comprises a peripheral surface which engages the borehole wall when in an expanded position.

3. The tractor system of claim 2, wherein the combined peripheral surfaces of the plurality of blades engage a complete circumference of the borehole wall.

4. The tractor system of claim 2, wherein each peripheral surface comprises at least one traction component.

5. The tractor system of claim 4, wherein each fraction component comprises a ramp.

6. The tractor system of claim 1, further comprising a plurality of fins extending from the outer diameter of the mandrel of at least one of the expandable tools, a plurality of channels disposed on at least one fin of the plurality of fins, a plurality of channels disposed on the slidable sleeve of the expandable tool, and a plurality of channels disposed on at least one blade of the plurality of blades of the expandable tool.

7. The tractor system of claim 6, wherein the manipulating the plurality of blades comprises engaging a plurality of channels on an interior surface of at least one blade with the plurality of channels on the at least one fin and engaging a plurality of channels on an exterior surface of the at least one blade with the plurality of channels on the slidable sleeve.

8. The tractor system of claim 1, wherein the piston cylinder device comprises pressure chambers disposed on two sides of a piston to axially translate at least one of the expandable tools.

9. A method of translating at least two expandable tools, comprising:

providing first and second expandable tools disposed along a common axis spaced apart from each other along the common axis and each comprising a mandrel comprising a tubular body and an outer diameter, a plurality of blades, and a slidable sleeve capable of manipulating the plurality of blades into collapsed and expanded positions;

providing a piston cylinder device between the at least two expandable tools comprising a cylinder connected to a mandrel of one of the expandable tools and a piston connected to a mandrel of another of the expandable tools;

engaging a borehole wall by expanding the plurality of blades of the first expandable tool;

translating the mandrel of the second expandable tool axially;

engaging the borehole wall by expanding the plurality of blades of the second expandable tool; and translating the mandrel of the first expandable tool axially.

10. The method of claim 9, wherein translating the mandrel of the first expandable tool axially or the second expandable tool axially causes the plurality of blades of either the first expandable tool or the second expandable tool to collapse from engagement with the borehole wall.

11. The method of claim 9, further comprising providing a drill bit and translating the drill bit axially.

* * * * *